US008425157B1

(12) United States Patent
Goranson

(10) Patent No.: US 8,425,157 B1
(45) Date of Patent: Apr. 23, 2013

(54) CLAMP FOR PILE DRIVING

(75) Inventor: Kelly Paul Goranson, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 13/407,734

(22) Filed: Feb. 28, 2012

(51) Int. Cl.
*E02D 7/02* (2006.01)

(52) U.S. Cl.
USPC ..... 405/232; 405/249

(58) Field of Classification Search ..... 405/231, 405/232, 249, 253, 274, 276
See application file for complete search history.

(56) References Cited

U.S. PATENT DOCUMENTS 3,815,373 A * 6/1974 Giroux ..... 405/231
5,544,979 A * 8/1996 White ..... 405/232
5,725,329 A * 3/1998 Chelminski ..... 405/232
5,823,272 A * 10/1998 van Halteren ..... 405/249
6,302,222 B1 * 10/2001 Vessat ..... 405/249
6,386,295 B1 * 5/2002 Suver ..... 405/232
6,540,443 B2 * 4/2003 Kato et al. ..... 405/232
6,648,556 B1 * 11/2003 White ..... 405/249
6,942,430 B1 * 9/2005 Suver ..... 405/232
7,407,343 B2 * 8/2008 van Halteren et al. ..... 405/232
7,708,499 B1 * 5/2010 Evarts et al. ..... 405/232
2006/0088388 A1 * 4/2006 Wissmann et al. ..... 405/232

* cited by examiner

*Primary Examiner* — Frederick L Lagman
(74) *Attorney, Agent, or Firm* — ÆON Law

(57) ABSTRACT

Disclosed is a two-part caisson-clamp, wherein each half of the caisson-clamp contains only one jaw face. The two half caisson-clamps together pinch the top of a pile between them. The jaw faces may have a concave curve to secure the pile between them. The pile extends up between the two caisson-clamps to contact the caisson-beam. Horizontal forces on the two caisson-clamps, which would otherwise drive the two caisson-clamps apart, are resisted by mechanical stop(s). A mandril may be inserted into the pile to reinforce the top of the pile relative to the forces applied and transferred by the half-caisson clamps.

24 Claims, 10 Drawing Sheets

Figure 1
PRIOR ART
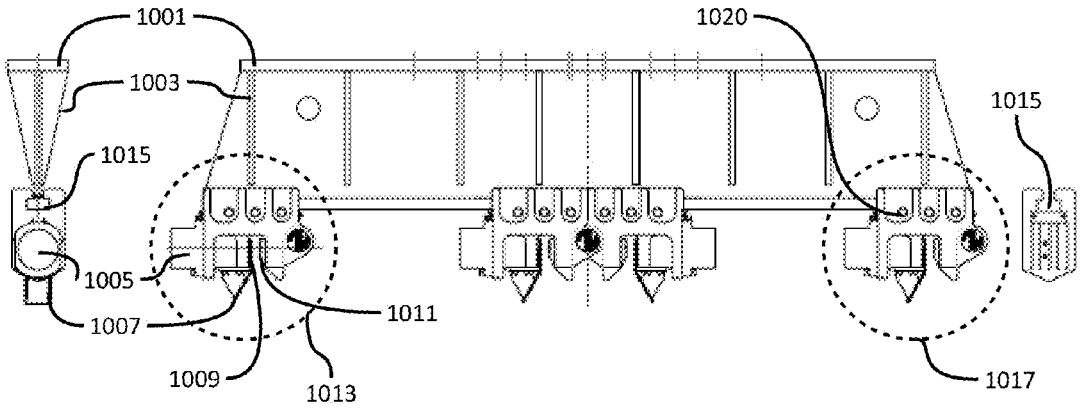
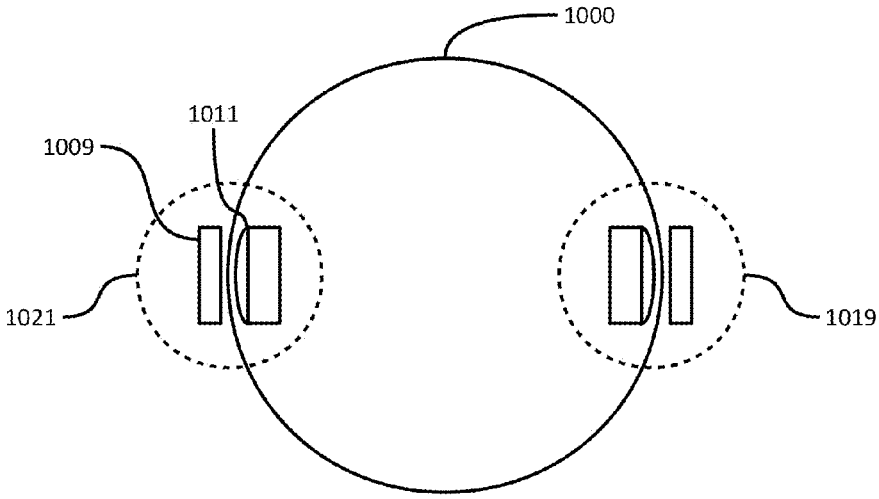

Figure 3.A
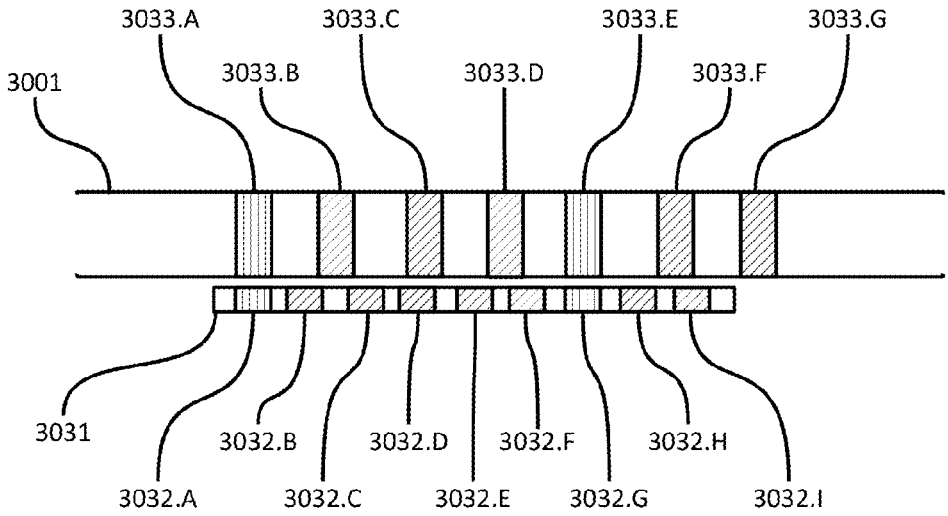
Figure 3.B
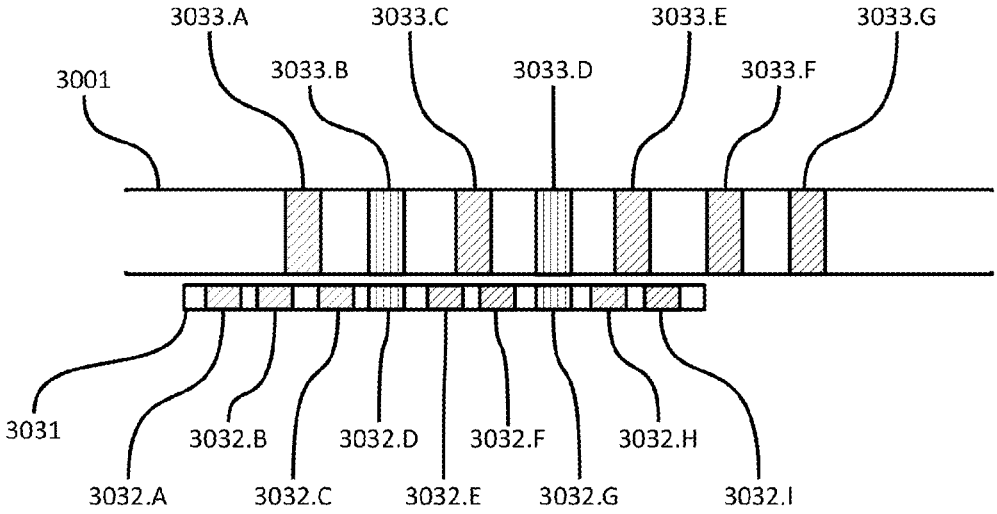

CLAMP FOR PILE DRIVING

BACKGROUND

In construction projects, rigid members, such as piles, sheet piles, poles, caissons, or other vertically oriented piles (hereinafter referred to as "piles") must sometimes be inserted into and/or withdrawn from the earth. Piles may be made out of wood, steel, reinforced and/or prestressed concrete, or other materials. Piles may have a square, rectangular, circular, "H" or other cross-section when viewed through a horizontal cross-section.

Pile insertion and extraction techniques typically involve applying a static force in conjunction with a dynamic, often vibrating force, both forces typically applied at or near the top of a pile. In pile insertion contexts, the static force is commonly provided by the weight of the pile and pile driving equipment while the dynamic force may be provided by i) a diesel, steam, or hydraulic drop hammer which raises a weight and drops it onto the upper end of the pile, ii) a hydraulic, gear, or roller-drive system which presses-in or crowds the pile into the earth, and/or iii) a vibratory system which, for example, may use a pair of balanced, counter-rotating eccentric weights (often obtaining power through a hydraulic connection to a remote power system) to vibrate the pile, which liquefies the earth in contact with the pile and allows the static force to push the pile into the earth (or withdraw it from the earth, in the case of extraction and application of a static lifting force).

Existing pile driving equipment typically includes a caisson-clamp attached to the top of the pile. An example of an existing clamp is shown in FIG. 1. FIG. 1 shows a caisson-beam 1001 and two caisson-clamps 1017 and 1013. The clamps 1017/1013 each comprise an adjustment mechanism 1005, a fixed jaw face 1011, an adjustable jaw face 1009, a pile guide 1007, and caisson-beam track 1015. In use, the distance between two such caisson-clamps is adjusted by sliding the clamps along the caisson-beam through the caisson-beam tracks. The distance between the caisson-clamps is first roughly selected to allow the fixed jaw face 1011 and adjustable jaw face 1009 to be lowered onto a pile. The adjustable jaw face 1009 may have a roughly flat face, as shown in the detail view in FIG. 1, while the fixed jaw face 1011 may have a convex curve, generally with a tighter arc angle than the interior of the pile into which the caisson-clamps are to be lowered. The adjustable jaw face 1009 may be tightened (via the adjustment mechanism 1005) against the outside of the pile, causing the clamp to adjust its position relative to the pile 1000 and causing the fixed jaw face 1011 to tighten against the inside of the pile 1000. The top of the pile 1000 is then pinched at two locations 1019 and 1021 by the jaw faces. Wedges 1020 may then be tightened to secure the position of the caisson-clamps 1013/1017 on the caisson-beam 1001.

As shown in FIG. 1, two caisson-clamps are shown at the approximate center of a caisson-beam, with the caisson-clamps having a left- and right-sided orientation as viewed in the figure (so that the adjustable jaw side of both clamps is on the exterior of the pile). Two caisson-clamps are also shown at opposite ends of the caisson-beam, caisson-clamps 1013 and 1017, both of which clamps are shown with a left-sided orientation. In use, caisson-clamp 1017 would be removed from the caisson-beam, rotated 180 degrees, and re-inserted onto the caisson-beam with a right-sided orientation.

The existing prior-art caisson-clamps require placement and replacement of four jaw faces and often require clamps and/or jaw faces sized to specific piles or narrow ranges of piles. Existing caisson-clamps often require that the pile be machined, welded, cut, ground, or otherwise modified prior to and/or after insertion or extraction, procedures which take time, expertise, and which may add cost, time, and complexity to a pile insertion and/or extraction procedure as well as to utilization of the pile after the insertion and/or extraction procedure. The pile used in prior-art systems must be hollow to accommodate the caisson-clamps or must be modified to accommodate the caisson-clamps. Needed is a pile clamp which addresses these shortcomings.

SUMMARY OF THE INVENTION

Disclosed is a two-part caisson-clamp, wherein each half of the caisson-clamp contains only one jaw face. The two half caisson-clamps together pinch the top of a pile between them. The jaw faces may have a concave curve to secure the pile between them. The pile extends up between the two caisson-clamps to contact the caisson-beam. Horizontal forces on the two caisson-clamps, which would otherwise drive the two caisson-clamps apart, are resisted by mechanical stop(s). A mandril may be inserted into the pile to reinforce the top of the pile relative to the forces applied and transferred by the half-caisson clamps.

DESCRIPTION OF THE DRAWINGS

FIG. 1 depicts a prior art set of caisson-clamps in an elevation view and a plan view of a prior art set of caisson-clamps clamped to a pile.

FIG. 3.A depicts an elevation view of an embodiment of a mechanical stop according to this disclosure.

FIG. 3.B depicts an elevation view of an embodiment of a mechanical stop according to this disclosure.

DETAILED DESCRIPTION

The following description of the drawings and detailed description refers to the accompanying drawings. The reference numbers generally begin with a numeral which identifies the figure, followed by another numeral which identifies the feature. The same feature number in different drawings generally identify the same or similar elements and/or components. The following detailed description is for the purpose of illustrating embodiments of the invention only, and other embodiments are possible without deviating from the spirit and scope of the invention, which is limited only by the appended claims. Certain of the figures are discussed in this specification using certain terms. The following discussion uses these terms and related terms as examples and not as limitations. The components depicted in certain of the figures represent functional groups; it should be understood that such functional groupings need not exist as discrete hardware devices and that the functions described as occurring within, comprising, or being provided by a grouping may be provided within or by common or separate physical devices. The functions within and comprising any of the function groupings may be regrouped in other combinations and certain of the components may be omitted or added without deviating from the spirit of the disclosed invention. Certain of the groupings depict components which are included together in the illustration for the sake of convenience. Certain of the figures depict components in isolation; the components from different figures may be combined and/or regrouped. As used herein, "releasable," "releasably" and similar shall mean being able to repeatedly connect/disconnect (or engage/disengage) through the use of hands, feet, or human appendage with or without use of a tool (including power tools), and without the need for removal of material or application of a high temperature (greater than approximately 150 degrees Fahrenheit). Examples of "releasable" components include nuts and bolts, screws and a threaded receptacle, friction locking cams or chocks or wedges (female and male), hydraulic pistons and straps and tensioning levers. Not considered "releasable" are components attached to another component by chemical bonding or welding or which are removed from another component through use of a saw, drill, grinding tool, other material removal tool, or high intensity heat source (such as a welder or high-temperature cutting tool).

Figure 2:
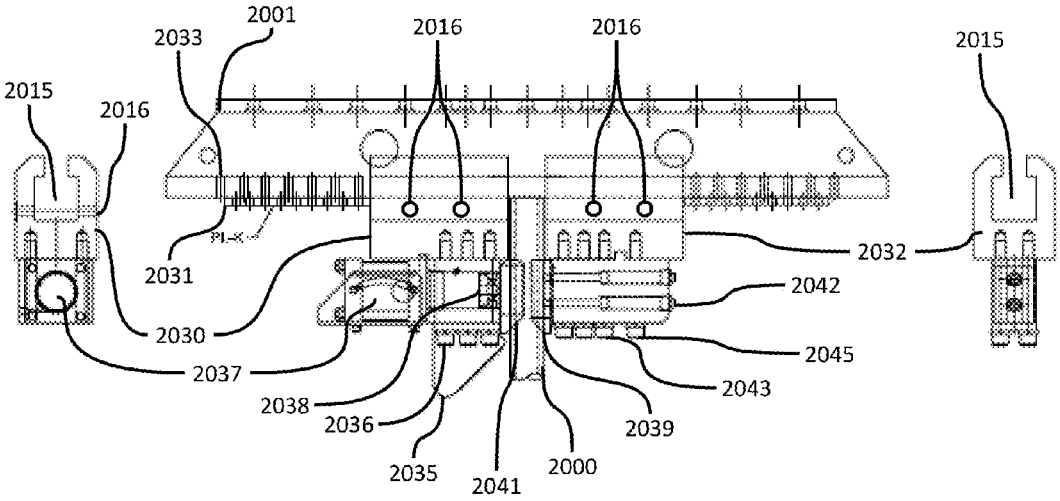
FIG. 2 depicts an elevation view of an embodiment of a caisson-clamp according to this disclosure.
Figure 6:
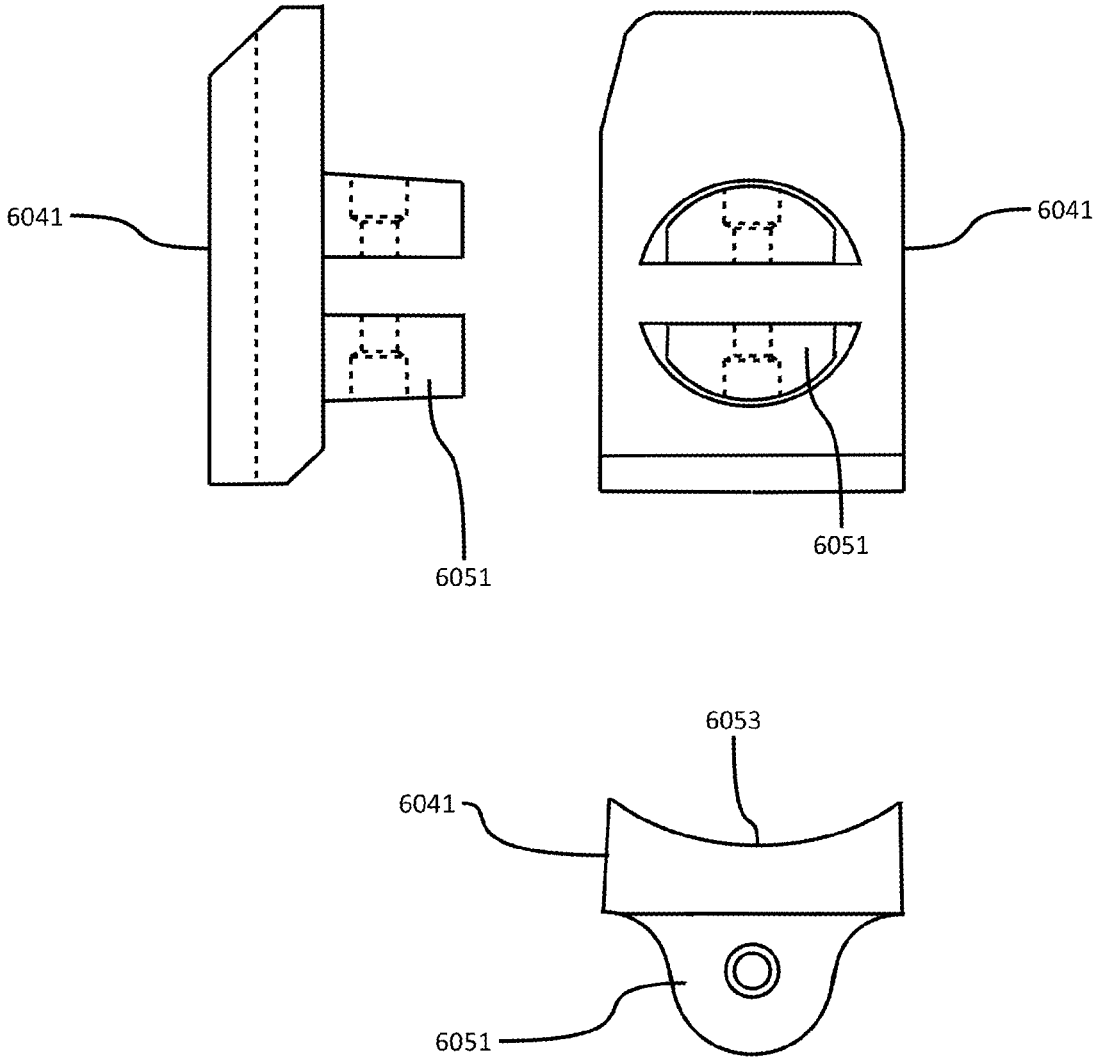
FIG. 6 depicts elevation and plan views of an embodiment of a pile jaw to be attached to a moveable jaw holder.

FIG. 2 depicts an elevation view of an embodiment of a caisson-clamp according to this disclosure. A caisson-beam 2001 is shown with two attached half-caisson clamps 2030 and 2032. Half-caisson clamp 2030 comprises a caisson-beam track 2015, a wedge 2016, moveable jaw holder connecting bolts 2036, and moveable jaw holder comprising a piston 2037, a connecting rod 2038, a guide fin 2035, and a moveable pile jaw face 2041. Details of an embodiment of a moveable pile jaw face 2041 are shown in FIG. 6.

The caisson-beam track 2015 is an example of means to connect the half caisson-beam clamp to the caisson-beam. Alternative means to secure the half caisson-beam clamps along the length of the caisson-beam are possible; examples include a caisson-beam comprising an opening (or other geometry) into which the caisson-beam clamp may be inserted (or otherwise may be coupled with). The moveable jaw holder and components thereof are examples of means for a moveable jaw holder; the piston 2037 may be powered by a hydraulic power system attached to hoses on or in the vicinity of the piston 2037; the moveable jaw holder may, for example, provide a horizontal movement range of 2¼"; a jack screw or similar is an example of an alternative to the components for the moveable jaw holder.

The wedge 2016 may comprise components such as bolts attached to at least one threaded chock in a set of metal chocks, which chocks are in a wedge relationship (at least two of the chocks having overlapping sides with an angle greater or less than horizontal); such that when the bolt(s) are turned to tighten the wedge 2016, the threaded chock(s) slides along the other, forcing both chocks outward, generally perpendicular to their non-horizontal overlapping side, against the interior of the caisson-beam track 2015 and against the caisson-beam 2001, thereby wedging the half-caisson clamp against the caisson-beam. The wedge 2016 holds the half-caisson clamp in a relationship with the caisson-beam, but is not expected to secure the half-caisson clamp against horizontal forces experienced during use. The wedge 2016 may be powered by a human-powered tool, such as a wrench, or by a power tool, or by a hydraulic power source.

Figure 7:
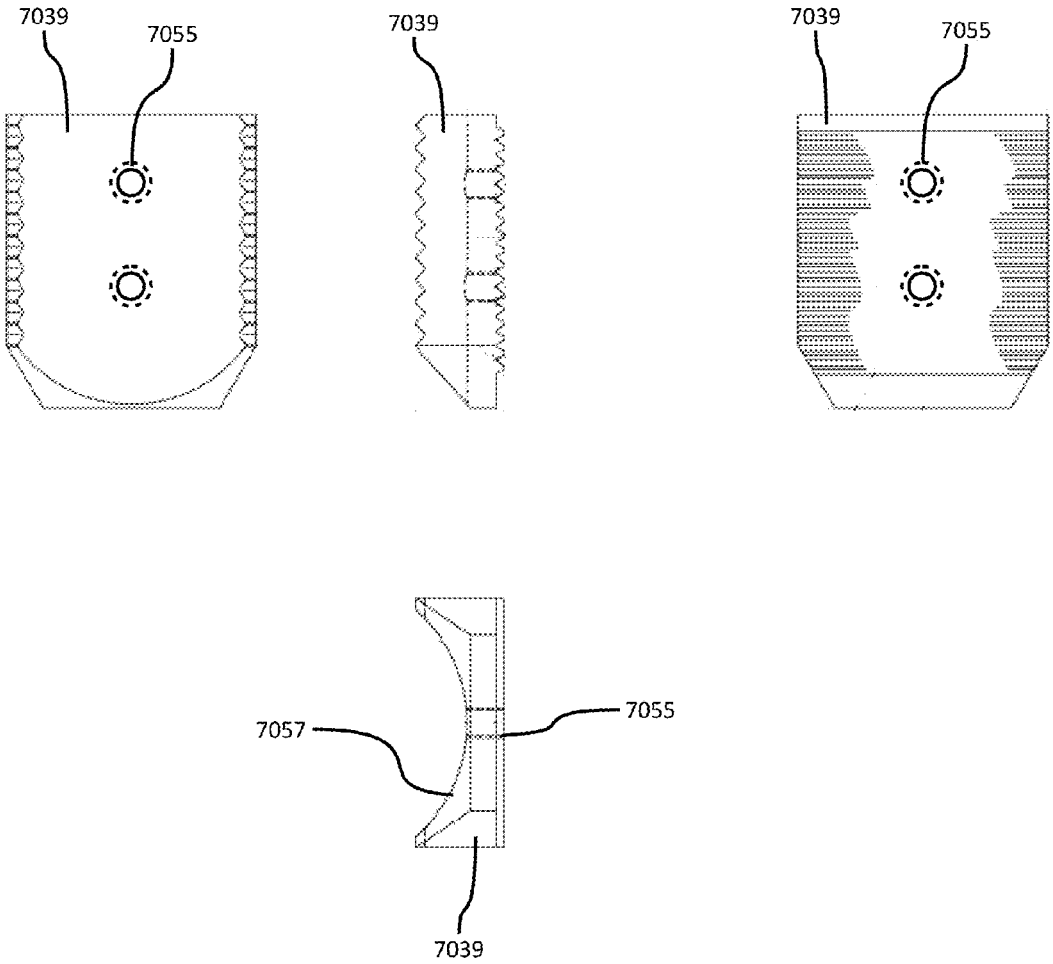
FIG. 7 depicts elevation and plan views of an embodiment of a pile jaw to be attached to a fixed jaw holder.

Half-caisson clamp 2032 comprises a caisson-beam track 2015, a wedge 2016, and a fixed jaw holder comprising a fixed jaw face 2039, fixed jaw face attachment bolts 2042, and fixed jaw holder attachment bolts 2043 and 2045. Details of an embodiment of a fixed pile jaw face 2039 are shown in FIG. 7.

Figure 9:
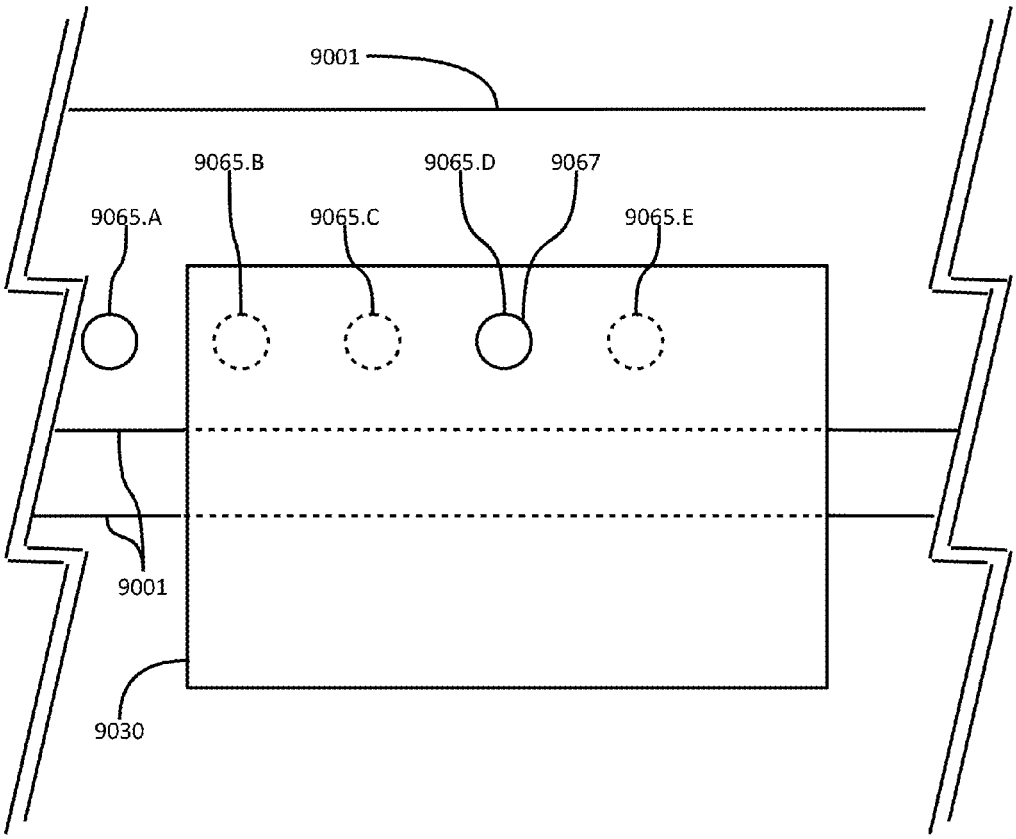
FIG. 9 depicts an elevation view of an embodiment of a mechanical stop.

Also shown in FIG. 2 is a mechanical stop 2031 comprising a plate with holes drilled in it as well as holes drilled in the caisson-beam 2033. A detailed plan view of the plate-based mechanical stop and caisson-beam are shown in FIGS. 3.A and 3.B., while an alternative is shown in FIG. 9. Discussing FIGS. 2, 3, and 9, the illustrated mechanical stop is an example of means to secure the half-caisson clamps against the horizontal forces experienced during use. With respect to FIG. 2, the holes in the mechanical stop 2031 as well as in the caisson-beam 2033 are chosen to allow a pile to be inserted between the half-caisson clamps taking into consideration factors such as i) that piles tend to have standard diameters, typically, for example, between 4" and 12"; ii) taking into consideration the horizontal offset created by the width of the half-caisson clamp and the width of the mechanical stop; and iii) taking into consideration the horizontal movement range of the moveable jaw holder (approximately 2¼").

As shown in FIG. 3.A as an example, the set of holes 3032.A (in the mechanical stop 3031) and 3033.A (in the caisson-beam 3001) and the set of holes 3032.G (in the mechanical stop 3031) and 3033.E (in the caisson-beam 3001) line up and may receive bolts, thereby securing the mechanical stop 3031 to the caisson-beam 3001, which secured mechanical stop 3031 may secure a half-caisson clamp against horizontal forces experienced during use. As shown in FIG. 3.B as an example, the set of holes 3032.D (in the mechanical stop 3031) and 3033.B (in the caisson-beam 3001) and the set of holes 3032.G (in the mechanical stop 3031) and 3033.D (in the caisson-beam 3001) line up and may receive bolts, thereby securing the mechanical stop 3031 to the caisson-beam 3001, which secured mechanical stop 3031 may secure a half-caisson clamp against horizontal forces experienced during use. The holes and relative hole-spacing in FIGS. 3.A and 3.B are shown as examples.

FIG. 9 depicts an alternative mechanical stop in which the caisson-beam 9001 (shown as a partial view) has holes 9065.A, 9065.B, 9065.C, 9065.D, and 9065.E. In this example, half-caisson clamp 9030 (also shown as a partial view) has hole 9067. When, as shown in FIG. 9, hole 9067 is lined up with one of the holes in the caisson-beam, hole 9065.D, a bolt, rod, pin or similar may be passed through the lined up holes, thereby releasably securing the half-caisson clamp 9030 against horizontal forces. The bolt, rod, pin, or similar may be secured with a nut, with a cotter pin, or similar. The holes in FIG. 9 are shown with a horizontally oriented central axis; it would be appreciated that a vertically oriented central axis may be used, in which case the holes may pass through the bottom portion of the caisson-beam or another portion of the caisson-beam with a suitable orientation.

Figure 10:
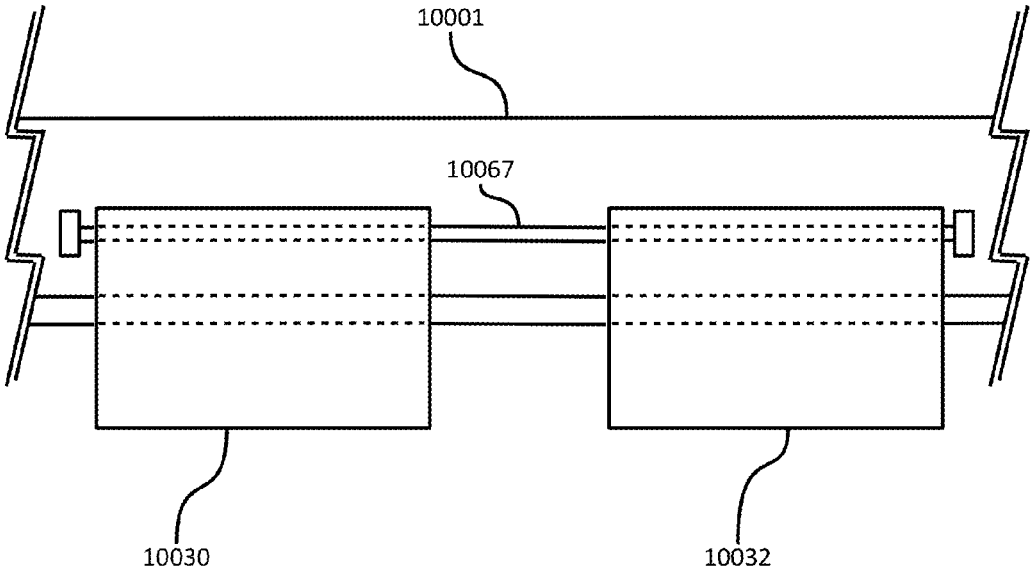
FIG. 10 depicts an elevation view of an embodiment of a mechanical stop.

FIG. 10 depicts an alternative mechanical stop in which the half-caisson clamps 10030 and 10032 are secured by mechanical stop 10067, comprising a bolt, rod, or similar. The mechanical stop 10067 may pass through a hole, channel, grove, or notch in the half-caisson clamps provided for this purpose. The ends of the mechanical stop 10067 may comprise one or more nuts, bolt-heads, or similar. Alternative mechanical stops not shown in the drawings include a belt, U-shaped bracket, or similar going around or attaching to one half-caisson clamp and going around or attaching to the other half-caisson clamp and/or the caisson-beam.

To clamp a different sized pile between the half-caisson clamps, the piston 2037 (if extended) may be withdrawn, the mechanical stop 2/3031 (if attached) may be unbolted from the caisson-beam 2/3001, the wedges 2016 may be loosened (if required), the half-caisson clamps 2030 and 2032 may be relocated along the caisson-beam 2001, the wedges 2016 may be tightened, the mechanical stops 2/3031 may be bolted to a new position, the new pile may be inserted into the space between the half-caisson clamps 2030 and 2032, and the piston 2037 may extended to clamp the pile between the moveable pile jaw face 2041 and the fixed pile jaw face 2039. One or more of these steps may be performed in another order.

Figure 4:
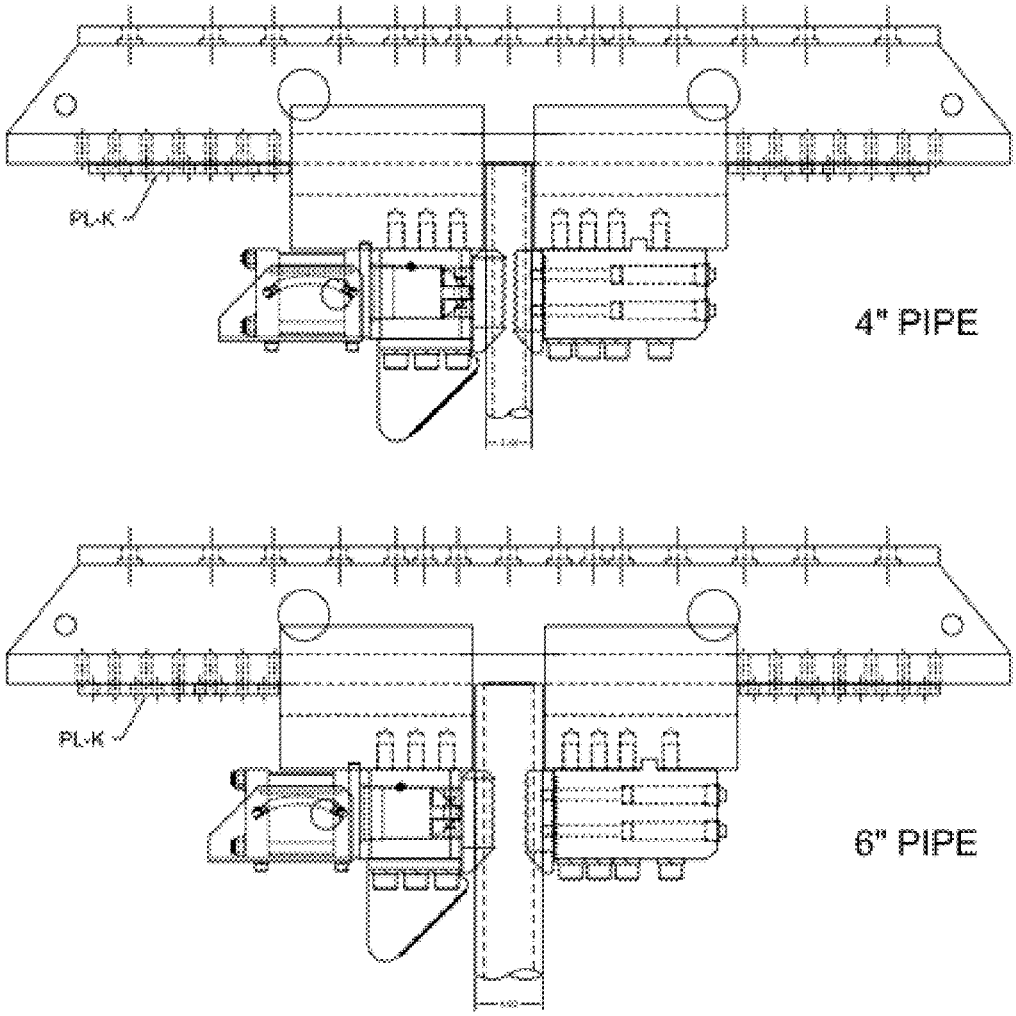
FIG. 4 depicts an elevation view of an embodiment of a caisson-clamp as clamped to 4" and 6" piles, according to this disclosure.

FIG. 4 depicts an elevation view of an embodiment of a caisson-clamp as clamped to 4" and 6" piles, according to this disclosure.

Figure 5:
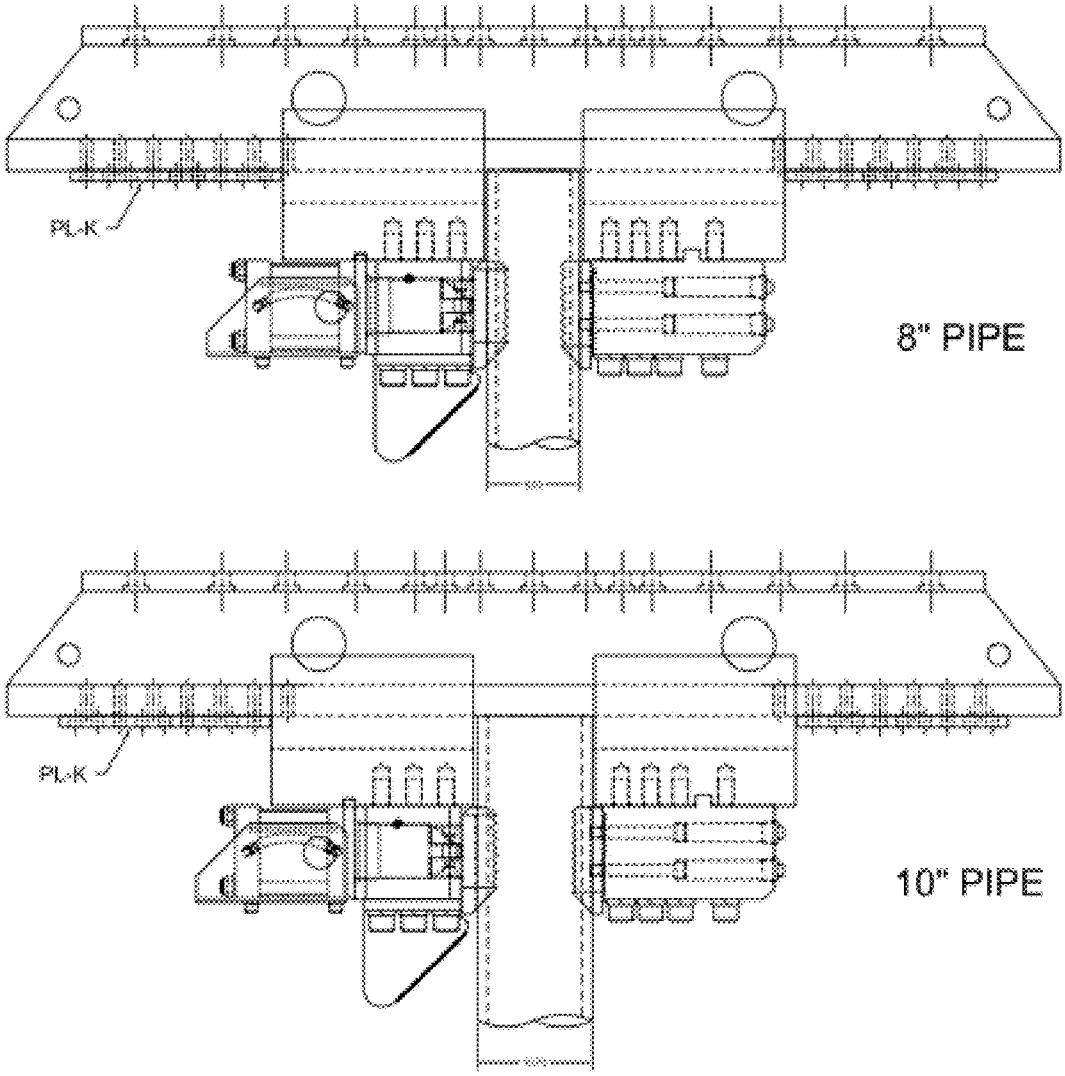
FIG. 5 depicts an elevation view of an embodiment of a caisson-clamp as clamped to 8" and 10" piles, according to this disclosure.

FIG. 5 depicts an elevation view of an embodiment of a caisson-clamp as clamped to 8" and 10" piles, according to this disclosure.

FIG. 6 depicts elevation and plan views of an embodiment of a pile jaw to be attached to a moveable jaw holder, moveable pile jaw face 6041. The depicted moveable pile jaw face 6041 has a concave portion 6053 to receive a pile. Shown is a moveable pile jaw face bracket 6051, drilled to receive a bolt, rod, or similar to secure the moveable pile jaw face 6041 to the connecting rod 2038.

FIG. 7 depicts elevation and plan views of an embodiment of a fixed jaw face 7039 to be attached to a fixed jaw holder. The fixed jaw face 7039 is depicted as having holes 7053 to receive fixed jaw face attachment bolts 2042. The fixed jaw face 7039 has a concave portion 7057 to receive a pile.

The arc radius of the pile jaw face may be selected to approximate and/or be slightly larger than the arc radius of the pile to which the system is to be clamped.

Unlike the prior art, in which the jaw faces are flat or convex and in which two sets of jaw faces are required in each caisson-clamp, one set on each side of the pile (see 1021 and 1019—a total of four jaw faces), the present invention utilizes two jaw faces, one per caisson-clamp, both of which jaw faces are concave. Unlike the prior art—in which the pile contacts the top of the caisson-clamps, in which the pile must be modified or reinforced to be driven into or extracted from the ground—in the demonstrated system, the pile contacts the caisson-beam, the pile does not need to be modified or reinforced, resulting in less damage to both the half-caisson clamps, the jaw faces, and the pile. Horizontal forces experienced by the half caisson-clamps during use are resisted by a mechanical stop.

Figure 8:
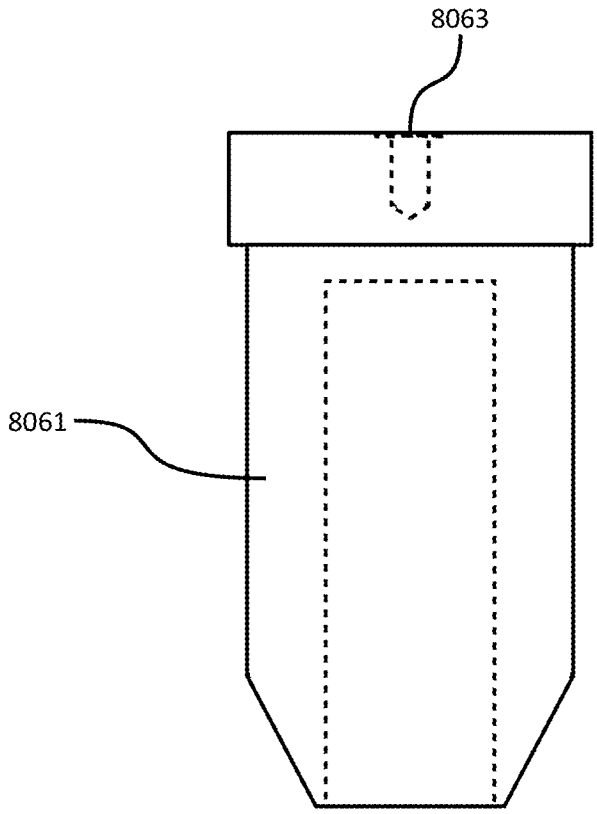
FIG. 8 depicts an elevation view of a mandril.

FIG. 8 depicts an elevation view of a mandril 8061. The mandril 8061 may have a hole 8063 to receive a bolt or similar to facilitate utilization of the mandril. The mandril 8061 may optionally be inserted into the pile to reinforce the pile against deforming forces which may be experienced during insertion or extraction of the pile. A mandril may not be used with the prior art.

The invention claimed is:

1. An apparatus for clamping to a pile to be driven into or extracted from the ground, comprising:

a first half caisson-clamp comprising:

a first caisson-beam track, a moveable jaw holder, comprising:

a first pile jaw face, a piston connected to the first pile jaw face;

a second half caisson-clamp comprising:

a second caisson-beam track, a fixed jaw holder, comprising:

a second pile jaw face; and a mechanical stop;

wherein the mechanical stop prevents the half-caisson clamps from horizontal movement away from each other;

wherein the first half caisson-clamp does not comprise a fixed jaw holder; and wherein the second half caisson-clamp does not comprise a moveable jaw holder.

2. The apparatus of claim 1 further comprising a caisson beam.

3. The apparatus of claim 2 wherein the caisson beam is engaged with at least one of the half caisson-clamps via at least one of the caisson-beam tracks.

4. The apparatus of claim 1 wherein the mechanical stop comprises a releasable connection between the mechanical stop and the caisson-beam.

5. The apparatus of claim 1 wherein the mechanical stop comprises a releasable connection between a half-caisson clamp and the caisson-beam.

6. The apparatus of claim 1 wherein the mechanical stop comprises a releasable connection between a half-caisson clamp and the other half-caisson clamp.

7. The apparatus of claim 4 wherein the mechanical stop comprises a plate.

8. The apparatus of claim 7 wherein bolts or rods pass through holes in the plate and the caisson-beam.

9. The apparatus of claim 8 wherein the holes are spaced to releasably connect the plate to the caisson-beam when the half-caisson clamps are clamped to standard diameter piles.

10. The apparatus of claim 9 wherein the range of standard diameter piles is 4" to 12".

11. The apparatus of claim 8 wherein the holes in the caisson-beam are spaced in symmetrical pairs on both sides of an anticipated centerline of a pile.

12. The apparatus of claim 11 wherein the pairs of holes have a spacing determined by the diameter of the pile plus or minus an offset.

13. The apparatus of claim 5 wherein the releasable connection between the half-caisson clamp and the caisson-beam comprises holes in the half-caisson clamp and the caisson-beam, which holes may be aligned to accept a bolt or rod, which bolt or rod releasably connects the half-caisson clamp to the caisson-beam.

14. The apparatus of claim 6 wherein the releasable connection between the half-caisson clamp and the other half-caisson clamp comprises at least one of a bolt, rod, bracket, or strap from the half-caisson clamp to the other half-caisson clamp, which bolt, rod, bracket, or strap prevents the half-caisson clamps from moving horizontally.

15. The apparatus of claim 1 wherein at least one of the first and second pile jaw faces have a concave portion to receive a pile.

16. The apparatus of claim 1 wherein at least one of the first and second pile jaw faces comprise hardware to releasably attach the pile jaw face to the piston and/or a jaw holder.

17. The apparatus of claim 16 wherein the attachment hardware for the first pile jaw face releasably attaches the first pile jaw face to a connecting rod, which connecting rod is connected to the piston.

18. The apparatus of claim 16 wherein the attachment hardware for the second pile jaw face releasably attaches the second pile jaw face to the fixed jaw holder.

19. The apparatus of claim 18 wherein the attachment hardware comprises bolt holes and bolts.

20. The apparatus of claim 15 wherein the concave portion has an arc radius at least as large as the arc radius of the outside diameter of a pile.

21. The apparatus of claim 1 further comprising a mandril for insertion into a pile.

22. The apparatus of claim 1 wherein the piston has a horizontal movement range of approximately 2¼".

23. The apparatus of claim 1 wherein at least one of the half-caisson clamps further comprises a wedge configured to restrain the movement of said half-caisson clamp relative to the caisson-beam.

24. The apparatus of claim 23 wherein the wedge is engaged and/or disengaged via a hydraulic and/or mechanical mechanism.

* * * * *